United States Patent [19]

Bentley

[11] 4,295,799

[45] Oct. 20, 1981

[54] SONIC PRESSURE WAVE SURFACE OPERATED PUMP

[76] Inventor: Arthur P. Bentley, P.O. Box 1952, Roswell, N. Mex. 88201

[21] Appl. No.: 958,552

[22] Filed: Nov. 8, 1978

[51] Int. Cl.[3] ..... F04B 47/12

[52] U.S. Cl. ..... 417/240; 417/378

[58] Field of Search ..... 417/53, 240, 241, 377, 417/383, 378

[56] References Cited

U.S. PATENT DOCUMENTS

| | | | |
|---|---|---|---|
| 2,355,618 | 8/1944 | Bodine, Jr. | 417/240 X |
| 2,379,539 | 7/1945 | Mercier | 417/240 |
| 2,572,977 | 10/1951 | Bodine, Jr. | 417/241 X |
| 2,751,848 | 6/1956 | Smith | 417/240 |
| 3,277,831 | 10/1966 | Chenoweth | 417/240 |
| 3,804,557 | 4/1974 | Bentley | 417/402 |

FOREIGN PATENT DOCUMENTS

| | | | |
|---|---|---|---|
| 1041371 | 10/1978 | Canada | 417/383 |
| 123282 | 9/1901 | Fed. Rep. of Germany | 417/240 |

*Primary Examiner*—Leonard E. Smith
*Attorney, Agent, or Firm*—Herbert E. Haynes, Jr.

[57] ABSTRACT

A single tube surface operated pump including a piston reciprocally mounted in a cylinder for alternately opening and closing a lateral fluid delivery port and for generating a sonic pressure wave by impacting a column of fluid in a metallic tube extending from the cylinder to a remote pumping mechanism located in communication with the fluid to be pumped. The piston is especially configured with a central recess in the face thereof so that the sonic pressure waves generated thereby will pass through a sonic nozzle and move downwardly toward the pumping mechanism in a spiral-like motion against the inner wall of the metallic tube and enter into a sonic intensifier chamber and are reflected off the pumping mechanism into a central column which travels back toward the cylinder and causes the fluid to be pumped to move in that same direction.

18 Claims, 4 Drawing Figures

SONIC PRESSURE WAVE SURFACE OPERATED PUMP

BACKGROUND OF THE INVENTION

1. Field of the Invention

This invention relates to pumps and more particularly to an improved sonic pressure wave surface operated pump.

2. Description of the Prior Art

It is well known to provide a pumping mechanism at an underground level to pump liquid from that level to the surface, with such a down hole pump being operated by a surface located mechanism which reciprocally impacts a column of liquid contained within a tube that communicates between the surface located mechanism and the down hole pump. The surface located mechanism, in addition to impacting the column of liquid, is reciprocally operated to alternately open and close a liquid delivery port. The impaction of the standing column of liquid produces hydraulic pressure waves that are transmitted by the liquid to the down hold pump to impart a reciprocal movement thereto. The down hole pump includes a plunger, or similar mechanism, which is biased upwardly by suitable springs, and has a central passage formed axially therethrough with a one-way check valve located in the lowermost end of the passage. When the hydraulic pressure waves move the plunger down against the spring bias, the check valve opens to admit the liquid being pumped into the passage, and the subsequent upstroke of the plunger closes the check valve and causes a general upward movement of the standing column of liquid with the uppermost portion thereof exiting through the fluid delivery port formed in the surface located mechanism.

Examples of the above described pumping mechanisms, and others which operate on that same basic principle, are fully disclosed in U.S. Pat. Nos. 2,379,539, 2,355,618, 2,572,977, 2,751,848, and 3,277,831.

These prior art pumps critically depend upon ideal adjustment of the input frequency relative to the length of the tube in which the standing column of liquid is contained, that is, resonant timing. Further, such prior art pumps are seriously limited in their pumping capacities due to such factors as inertia of the liquid, and the like.

SUMMARY OF THE INVENTION

In accordance with the present invention, a sonic pressure wave surface operated signal tube pump is disclosed as including a surface located sonic pressure wave generator from which a metallic tube depends so as to communicate with an underground, or down hole pumping mechanism that is located at the level of the liquid to be pumped.

The sonic pressure wave generator includes a vertically disposed cylinder having a lateral liquid delivery port formed therein which is coupled to a remotely located liquid receiving reservoir. A piston of special configuration is mounted in the cylinder and is reciprocally operated therein by suitable drive means, with that reciprocal movement alternately opening and closing the liquid delivery port. Additionally, the reciprocal movement of the piston will cause it to impact a standing column of liquid disposed in the metallic tube to produce sonic pressure waves of special character. The liquid impacting face of the piston is formed with a centrally located truncated conical recess or cavity which extends upwardly into the piston with the upper end of that recess communicating with a blind cylindrical bore formed axially in the piston. Thus, the lower surface or liquid impacting face of the piston is of ring-like configuration.

Impacting of the standing column of liquid contained within the metallic tube by a piston configured as described above produces sonic pressure waves which pass through a sonic nozzle and move downwardly along the inner walls of the metallic tube in a spiral-like motion.

The underground, or down hole pumping mechanism which is coupled to the lowermost end of the metallic tube is of generally cylindrical configuration having an axial bore formed therein. The uppermost end of the axial bore is especially configured to form a sonic intensifier chamber which receives the downwardly spiraling sonic pressure waves and causes an increase in the velocity thereof. A plunger is reciprocally mounted in the axial bore of the housing with that plunger having an axial passage formed therethrough with a one-way check valve located at the lowermost end of that passage. The plunger is biased upwardly by a compression spring which counterbalances the weight of the standing column of liquid. The downwardly spiraling sonic pressure waves, which are increased in velocity in the intensifier chamber, impinge upon the head of the plunger about its periphery thus forcing the plunger down which opens the check valve and admits the liquid being pumped to the axial passage formed through the plunger. The impinging sonic pressure waves are reflected by the head of the plunger inwardly and upwardly into a column centrally of the metallic tube. This upwardly moving central column will carry the liquid being pumped with it.

The pump of the present invention configured as described above, produces high pump output pressure and velocity, as compared with prior art pumps such as those hereinbefore described, with that output pressure and velocity being considerably higher than could be reasonably expected from a pump which operates upon hydraulic pressures alone. Exactly what takes place in the pump of the present invention is not clearly understood. It is known that the special configuration of the piston and the sonic nozzle located in the sonic generator produces the sonic pressure waves of a special character and those waves, in conjunction with the sonic intensifier chamber in the down hole pumping mechanism, are responsible for the pump's performance. Exhaustive tests and experiments show that the generated sonic pressure waves move along the inner walls of the metallic tube in a spiral or threadlike motion and those downwardly spiraling waves do not appear to exert any downwardly applied pressure or other force on the liquid in the center of the tube. The downwardly spiraling pressure waves increase in velocity upon entering the sonic intensifier chamber and are reflected inwardly and upwardly as hereinbefore described. The upwardly moving central column of liquid is believed to be augmented with regard to pressure and velocity, by counteraction with the downwardly spiraling waves acting like a worm gear or lead screw to force the central column countercurrent to the generated pressure waves.

Accordingly, it is an object of the present invention to provide a new and useful pump.

Another object of the present invention is to provide a new and useful sonic pressure wave surface operated single tube pump.

Another object of the present invention is to provide a new and useful sonic pressure wave surface operated single tube pump having high pump output pressure and velocity as compared to known pumps.

Another object of the present invention is to provide a new and useful pump of the above described type which includes an aboveground sonic pressure wave generator which is coupled by a metallic tube to an underground pumping mechanism located at the level of the liquid to be pumped.

Another object of the present invention is to provide a new and useful pump of the above described type in which the aboveground sonic pressure wave generator includes a reciprocally operable piston which upon impacting a standing column of liquid contained within the metallic tube will generate sonic pressure waves which pass through a sonic nozzle and move downwardly along the inner walls of the tube in a spiral motion.

Another object of the present invention is to provide a new and useful pump of the above described character in which the piston operable in the sonic pressure wave generator has a truncated conical recess formed centrally in its liquid impacting face with that recess opening into a blind cylindrical bore formed axially in the piston.

Another object of the present invention is to provide a new and useful pump of the above described character in which the underground pumping mechanism is provided with a sonic intensifier chamber for receiving the sonic pressure waves from the metallic tube and increasing the velocity thereof.

Still another object of the present invention is to provide a new and useful pump of the above described character in which the underground pumping mechanism includes a plunger which is reciprocally operated by the sonic pressure waves to accomplish a pumping action, with the pressure waves impinging on the plunger and being reflected inwardly and upwardly therefrom to provide an upwardly moving central column of liquid in the metallic tube, with that central column of liquid carrying the liquid being pumped with it to the surface.

The foregoing objects of the present invention, as well as the inventin itself, may be more fully understood from the following description when read in conjuction with the accompany drawings.

DESCRIPTION OF THE PREFERRED EMBODIMENT

Figure 1:
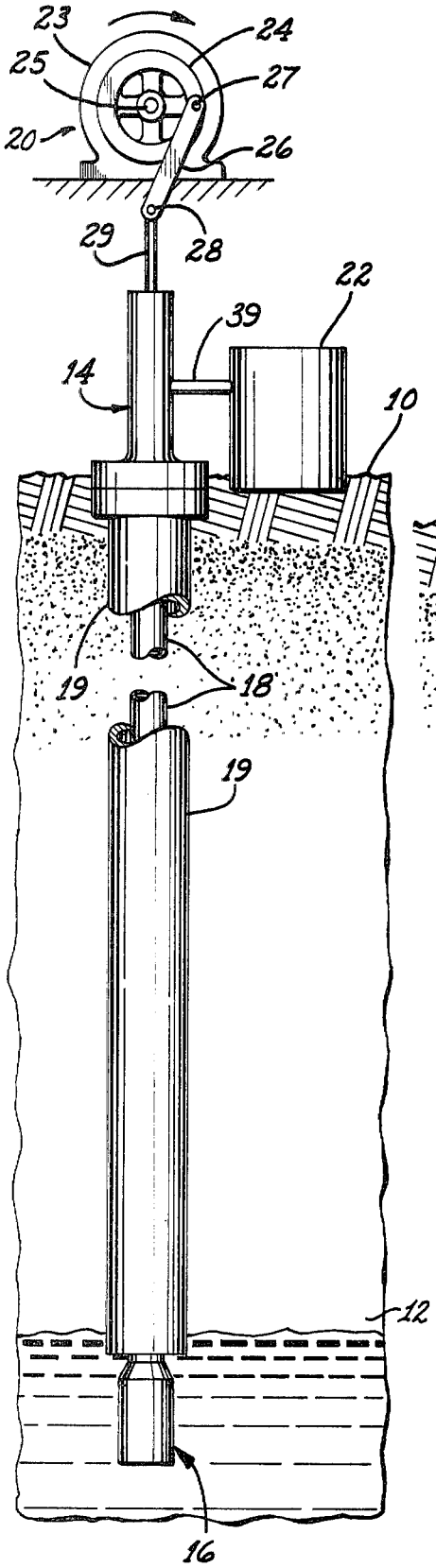
FIG. 1 is a section through a ground formation and illustrating the sonic pressure wave surface operated pump of the present invention in elevation within that ground formation.

Referring more particularly to the drawings, FIG. 1 illustrates a ground formation having a surface level 10 and an underground level 12 containing liquid which is to be pumped, such as water, oil, and the like. The sonic pressure wave surface operated pump of the present invention is seen to be located in the ground formation in a conventional manner, and the pump includes, as will hereinafter be described in detail, an aboveground sonic pressure wave generator, which is identified in its entirety by the reference numeral 14, an underground pumping mechanism which is indicated generally by the reference numeral 16, and an interconnecting metallic tube 18.

It will be noted that in accordance with standard practices, particularly in the oil well art, the bore formed in the ground formation is lined with a casing 19.

FIG. 1 also illustrates a drive means 20 for operation of the aboveground sonic pressure wave generator 14, and a reservoir 22 for receiving the liquid pumped by the pump of the present invention.

The drive means 20 may be any of several well known mechanisms, and is shown for illustrative purposes as including an electric motor 23 which rotatably drives a fly wheel 24 that is carried on its output shaft 25. A crank arm 26 is connected on one of its ends by a pivot pin 27 eccentrically mounted on the fly wheel 24 and has its outer end connected by a similar pin 28 to a piston rod 29 extending from the sonic pressure wave generator 14. In this manner, the drive means 20 which is a rotatably driven mechanism, will supply reciprocal movement to the sonic pressure wave generator 14 as will hereinafter be described.

Figure 2:
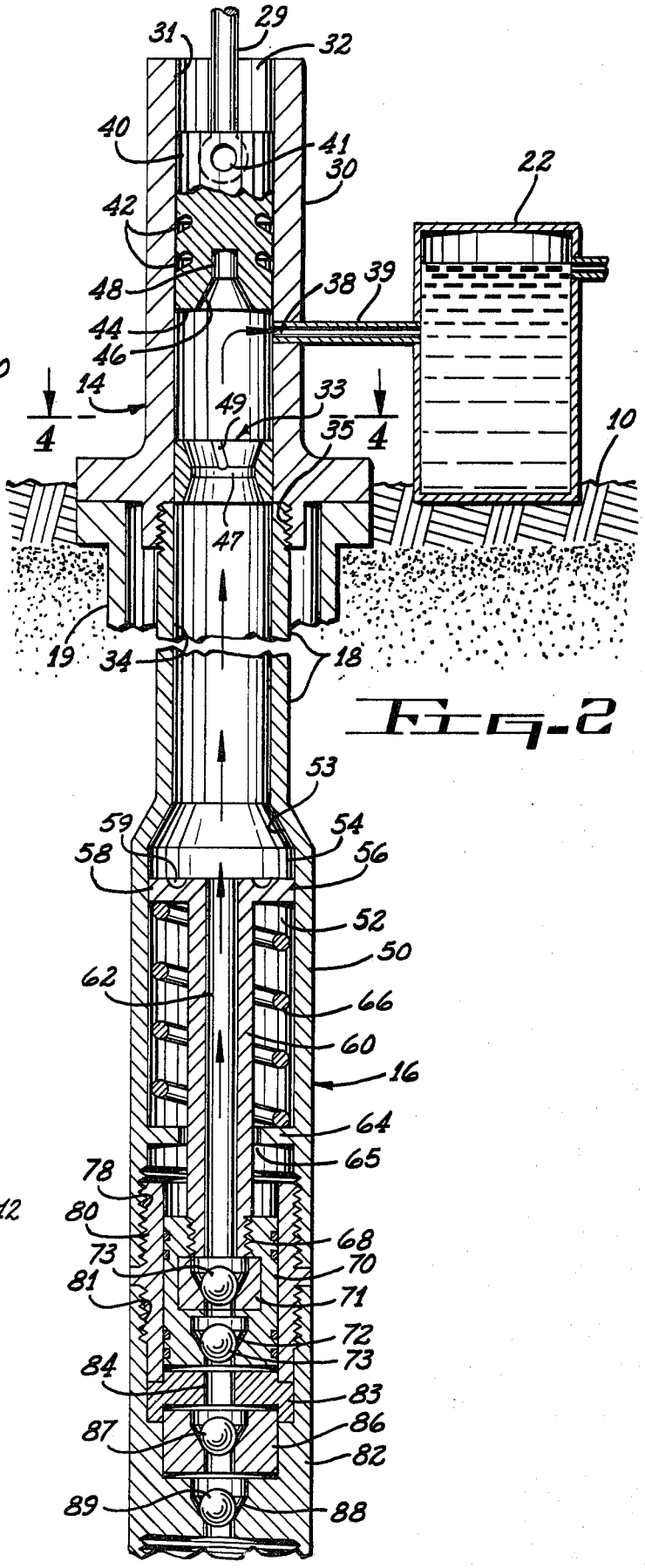
FIG. 2 is an enlarged vertical section taken through the sonic pressure wave surface operated pump of the present invention and illustrating one operational position of that pump.
Figure 3:
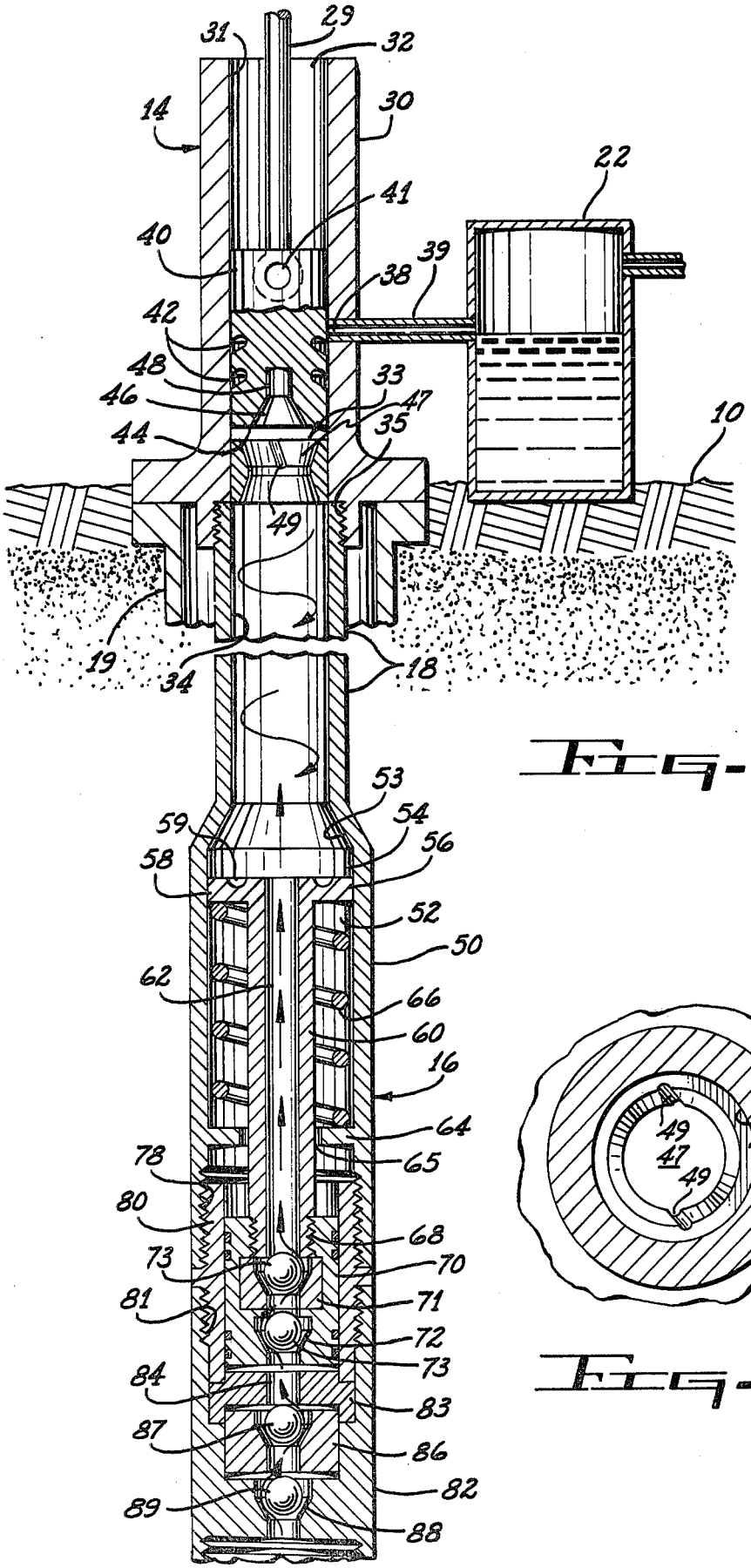
FIG. 3 is a view similar to FIG. 2 and showing the sonic pressure wave surface operated pump in a second operational position thereof.

Referring now to FIGS. 2 and 3, the sonic pressure wave generator 14 includes a vertically disposed cylinder 30 having an axial bore 31 formed therethrough, with that bore 31 having an open top 32 and a sonic nozzle 33 adjacent its open bottom. The top 32 of the bore 31 is open to accommodate the piston rod 29, and the bottom is open so that it will communicate with the bore 34 formed through the metallic tube 18. The axial bore 31 of the vertical cylinder 30 is provided with internal threads 35 formed therein proximate the open bottom thereof which provides means for coupling the metallic tube 18 to The cylinder 30 in a manner which places the axial bore 31 of the cylinder 30 in communication with the bore 34 formed through the tube 18. The sonic nozzle 33 will hereinafter be described in detail.

The vertical cylinder 30 is also provided with a liquid delivery port 38 which extends laterally from the axial bore 31. A conduit 39 is connected to the outlet end of the port 38 and extends to the reservoir 22 for delivering pumped liquid thereto as will hereinafter become apparent as this description progresses.

The axial bore 31 provided in the vertical cylinder 30 has an especially configured piston 40 mounted therein. The upper end of the piston 40 has a suitable wrist pin 41 to which the previously mentioned piston rod 29 is connected in the conventional manner so that the reciprocal motion supplied by the drive means 20 will reciprocally move the piston 40 in the bore 31. The piston 40 is an elongated cylindrical structure having a plurality of annular labrynth grooves 42 which effectively prevent the upward escape of air and/or liquid from the cylinder 30. The lower, or fluid impacting face 44 of the piston 40 has a truncated conical cavity or recess 46 formed axially therein with the upper end of that cavity being in communication with a blind cylindrical bore or socket 48 formed axially in the piston. Thus, the fluid impacting face 44 of the piston 40 is of ring-like configuration.

Figure 4:
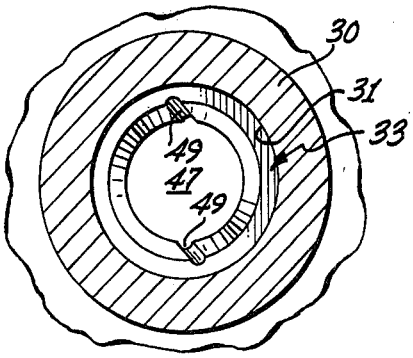
FIG. 4 is an enlarged fragmentary sectional view taken on the line 4—4 of FIG. 2.

The sonic nozzle 33 is seen to be a plug-shaped member or body which is affixed, such as by welding, in the bore 31 of the cylinder 30 adjacent the open bottom thereof. The nozzle 33 is provided with a bore 47 which is coaxial with respect to the bore 31 of the cylinder 30 and the bore 34 of the tube 18. The bore 47 of the nozzle 33 is configured with an upwardly disposed inverted frustroconical surface and a downwardly disposed frustro-conical surface. The upper conical surface is provided with a diametrically opposed pair of helical grooves 49 (FIG. 4) formed therein.

The metallic tube 18, which is connected to the bottom end of the sonic pressure wave generator 14, as hereinbefore described, contains a standing column (not shown) of the liquid being pumped. The downstroke of the piston 40 will cause the piston to impact the standing column of liquid which, due to the special configuration of the piston and the sonic nozzle will generate sonic pressure waves which move downwardly in a spiral-like path against the inner walls which define the bore 34 formed in the tube 18. It will be noted that the downstroke of the piston 40, as seen in FIG. 3, will close the lateral liquid delivery port 38 formed in the cylinder 30.

The underground, or down hole pumping mechanism 16, may be connected to the bottom end of the metallic tube 18 in any suitable manner with that connection being shown as the mechanism 16 being integral with the tube 18 for illustration purposes. In any case, the underground pumping mechanism 16 includes a housing 50 which is preferably of elongated cylindrical configuration due to the ease of lowering such a housing down through the casing 19. The housing 50 has an axial bore 52 formed therethrough, with that bore being of larger diameter than the bore 34 of the metallic tube 18, and is in axial communication therewith. The transition between the bores 34 and 52 is special in that the transition is accomplished by a truncated conical surface 53 which, in conjuction with the cylindrical area 54 immediately therebelow. defines a sonic imtensifier chamber. The sonic intensifier chamber receives the downwardly spiralling sonic pressure waves as they emerge from the lowerend of the metallic tube 18 and causes those waves to increase in velocity.

A plunger 56 is reciprocally mounted in the bore 52 of the housing 50, with that plunger having a head portion 58 at the upper end of a reduced diameter tubular body or stem 60. The plunger is axially disposed in the bore 52 and has an axial passage 62 formed therethrough so as to open upwardly onto the top surface of the head 58 centrally thereof and to open downwardly at the bottom end of the stem portion 60. The housing 50 is provided with an internal rib 64 which lies in a plane transverse to the longitudinal axis of the bore 52, and that rib has an opening 65 formed therethrough so as to be coaxial with the bore. A compression sping 66 is interposed between the downwardly facing surface of the head 58 and the upwardly facing surface of the rib 64. The spring 66 is specifically designed for each installation of the pump of the present invention so that the spring will substantially counterbalance the weight of the standing column of liquid in the metallic tube 18.

The lower end of the stem 60 of the plunger 56 extends through the opening 65 of the rib 64 and has external threads 68 formed thereon by which a check valve body 70 is threadingly attached. The body 70 has an axial bore formed therethrough with spacedly arranged vertically aligned valve seats 71 and 72 formed therein. A ball valve 73 is positoned in each of those valve seats, with those ball valves and their respecive valve seats constituting a bleed valve assembly by which occluded air or other gas in the liquid being pumped is prevented from reaching the axial passage 62 of the plunger 56. In many instances, such a bleed valve assembly will not be an absolute requirement.

The lower end of the housing 52 is provided with internal threads 78 with the externally threaded upper end of a nipple 80 threadingly secured therein. The externally threaded lower end of the nipple 80 is threadingly attached to the internal threads 81 formed in the upper end of an end fitting 82. The end fitting 82 has a cylinder end wall 83 mounted in its bore immediately below the nipple 80, and that end wall 83 is formed with a central opening 84 which is in axial alignment with the bore of the check valve body 70. A valve seat ring 86 is positioned in the bore of the end fitting 82 below the end wall structure 83, and the valve seat ring 86 has a central passage in which is positioned a ball valve 87. The lowermost end of the fitting 82 is provided with a second valve seat 88 and a ball valve 89 with a central opening extending downwardly therefrom into communication with the liquid to be pumped from the underground level 12 (FIG. 1).

It will be noted that although two ball valves are shown for the air bleed function, and two ball valves are shown at the lowermost end of the down hole pumping mechanism, in many instances, only one such ball valve will be necessary.

OPERATION

As hereinbefore mentioned, exactly what occurs in the sonic pressure wave surface operated pump of the present invention is not clearly understood. However, extensive testing and experimentation have shown the pump to produce much higher output pressure and velocity than could be reasonably expected from a pump operating on pure hydraulic principles. Those same tests and experiments lead me to believe that the pump operates in accordance with the following:

With the piston 40 of the aboveground sonic pressure wave generator 14 at the top of its upstroke as seen in FIG. 2, the lateral liquid delivery port 38 is open. When the piston 40 moves downwardly toward the bottom of its downstroke, as shon in FIG. 3, the piston will close the liquid delivery port 38 and will impact the standing column of liquid (not shown) that is contained in the lower portion of the axial bore 31 of the housing 30 and in the bore 34 of the metallic tube 18. Due to the special configuration of the piston 40, upon impacting the liquid column, it will generate a sonic pressure wave which spirals downwardly about the inner walls of the metallic tube 18 without exerting any appreciable forces on the central core of the standing liquid column.

Although the function of the sonic nozzle 33 is not clearly understood, it is thought that it may act somewhat in the manner of a venturi and thus increase the velocity of the sonic pressure waves. In initial testing of the pump, the nozzle was formed without the helical grooves 49, and the pump functioned quite well. However, an abrasive fluid was pumped during one testing sequence and very definite spiral or helical troughs were cut in the nozzle. After discovery of these troughs, the nozzle 33 was intentionally provided with the helical grooves 49 and this resulted in an improvement in the pumping capacity of the pump.

Upon reaching the lower end of the metallic tube 18, the downwardly spriraling sonic pressure waves emerge therefrom into the sonic intensifier chamber formed in the upper end of the down hole pumping unit 16, and will increase in velocity, and impinge upon the upper surface of the head portion 58 of the plunger 56. Such impingement will drive the plunger downwardly a sufficient amount to unseat the ball valves and admit the liquid being pumped into the axial passage 62 of the plunger. The impinging sonic pressure waves are reflected inwardly and upwardly to form an upwardly moving central column or core in the liquid within the metallic tube 18. This upwardly moving core will carry the liquid admitted to the passage 52 with it thus delivering that liquid to the aboveground sonic pressure wave generator 14 whereupon it will exit through the liquid delivery port 38. It is believed that the velocity and pressure of the upwardly moving central column of liquid is augmented by counteraction with the downwardly spiraling sonic pressure waves which act like a worm gear or lead screw that forces the central column countercurrent to the sonic pressure waves.

During the above mentioned initial testing of the pump, the top surface of the head 58 of the plunger 56 was flat, and the pump operated quite well. When the pump was disassembled during one of the routine inspections between tests, an endless groove 59 was machined into the previously flat top surface, and subsequent tests showed improved pumping capacity without any apparent increase in power consumption.

It will be understood that the rate of rotation of the fly wheel 24, and thus the rate at which the piston 40 reciprocates, is related to the depth of a particular well, and the time it takes a sonic pressure wave to travel the length of the metallic tube 18. The rate of travel of the sonic pressure wave will also depend upon the particular liquid being pumped and the metal of which the tube 18 is made. By way of example, it will be noted that if the tube 18 has a length of approximately 2,500 feet and the sonic pressure wave will have a travel rate of approximately 5,000 feet per second, which has been found to be true of many, if not most of the materials under and through which the sonic pressure wave passes, it will take one-half of a second for the downwardly directed sonic pressure wave to engage the head 58 of the plunger 56, and another one-half second for its echo return, making a total time of one second per cycle of the piston 40. This means that the piston 40 would have to reciprocate 60 times per minute. Obviously, the rate of rotation of the fly wheel 24 which causes a cycle of piston reciprocation would vary with wells of different depth to accommodate the time required for a sonic pressure wave to travel downwardly and be reflected upwardly.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A sonic pressure wave surface operated single tube pump for pumping liquid from an underground level to a ground surface comprising:

(a) a sonic pressure wave generator including,

I. a vertical cylinder having a bore for containing liquid in the lower portion thereof and having a port extending laterally from that bore, II. a piston reciprocal in the bore of said cylinder for opening and closing the port thereof and for reciprocally impacting the liquid contained therein, III. said piston having a liquid impacting end face with a central recess formed therein which generates a sonic pressure wave upon impacting the liquid containable therein, IV. a sonic nozzle located in the lower portion of the bore of said vertical cylinder;

(b) a power operated drive means coupled to said piston for reciprocal driving thereof;

(c) a metallic tube having one of its ends coupled to the lower end of said cylinder, said tube having a bore formed therethrough for containing liquid with that bore in communication with the bore of said cylinder for receiving and transmitting the sonic pressure waves upon generation in said cylinder; and (d) pumping mechanism means connected to the other end of said tube and in communication with the liquid to be pumped, said pumping mechanism means including a reciprocally operable plunger for impingingly receiving the sonic pressure waves when transmitted by said tube and reflecting those waves into a centrally and upwardly moving column.

2. A sonic pressure wave surface operated single tube pump as claimed in claim 1 wherein said sonic nozzle comprises:

(a) a plug-shaped body having an axial bore formed therethrough;

(b) said body having an upwardly disposed inverted frustroconical surface and a downwardly disposed frustro-conical surface which cooperatively form the axial bore through said body; and (c) said body having a diametrically opposed pair of helical grooves formed in the upwardly disposed inverted frustro-conical surface thereof.

3. A sonic pressure wave surface operated single tube pump as claimed in claim 1 and further comprising a liquid reservoir at the ground surface for containing liquid the same as the liquid to be pumped, said reservoir connected to the port of said cylinder.

4. A sonic pressure wave surface operated single tube pump as claimed in claim 1 wherein the central recess formed in the liquid impacting end face of said piston is of truncated conical configuration.

5. A sonic pressure wave surface operated single tube pump as claimed in claim 1 wherein the central recess formed in the liquid impacting end face of said piston is of truncated conical configuration which communicates with a blind cylindrical bore formed axially in said piston.

6. A sonic pressure wave surface operated single tube pump as claimed in claim 1 wherein the liquid impacting end face of said piston is of ring-like configuration with the central recess thereof being of truncated conical configuration which communicates with a blind cylindrical bore formed axially in said piston.

7. A sonic pressure wave surface operated single tube pump as claimed in claim 1 wherein said pumping mechanism means comprises:

(a) a housing having a bore for containing liquid and which communicates with the bore of said tube for receiving the sonic pressure waves upon transmission thereof by said tube, said housing having a lower end wall with a passage formed therethrough which communicates with the liquid to be pumped;

(b) said bore of said housing being of larger diameter than the bore of said tube and configured at its upper end to form a sonic intensifier chamber for increasing the velocity of the sonic pressure waves upon receipt thereof;

(c) a one-way check valve in the passage formed in the end wall of said housing.

(d) said plunger is reciprocally mounted in the bore of said housing and has a head from which a reduced diameter stem depends, said plunger having a passage formed axially therethrough;

(e) biasing means in the bore of said housing and bearing against said plunger to bias said plunger upwardly so as to counterbalance the weight of the liquid containable in said tube and in the lower portion of said cylinder; and (f) said plunger having a substantially flat upper surface for reflecting the sonic pressure waves which impinge thereon.

8. A sonic pressure wave surface operated single tube pump as claimed in claim 7 wherein the sonic intensifier chamber formed at the upper end of said housing comprises a truncated conical surface which forms the transition between the bore of said metallic tube and the bore of said housing.

9. A sonic pressure wave surface operated single tube pump as claimed in claim 7 wherein the substantially flat upper surface of said plunger is provided with an endless groove formed therein.

10. In a sonic pressure wave surface operated single tube pump for pumping liquid from an underground level to a ground surface comprising:

(a) a liquid reservoir at the ground surface for containing liquid the same as the liquid to be pumped;

(b) a sonic pressure wave generator including,

I. a cylinder having a bore and a lateral port communicating with said reservoir, II. a piston reciprocal in said cylinder and movable into positions opening and closing said port, III. said piston having an end face which engages liquid in the cylinder and which is formed with a central recess which generates a sonic pressure wave upon impact of said end face with the liquid, IV. a sonic nozzle located in the lower portion of the bore of said cylinder;

(c) power operated means for reciprocating said piston in said cylinder;

(d) a metallic tube connected to one end of said cylinder and extending through the ground formation to the underground level;

(e) a pumping mechanism at said underground level including,

I. a housing having a bore with its inner end connected to said tube and having a lower end wall formed with a passage communicating with liquid in the lower level, II. a one-way check valve in said passage, III. a plunger reciprocal in said housing and including a head from which depends a reduced diameter stem providing a passage through said plunger, IV. an internal rib in the bore of said housing, V. a compression spring interposed between said rib and the head of said plunger and exerting a force which counterbalances the weight of a column of liquid in said tube; and (f) said plunger head having a substantially flat upper surface for reflecting sonic pressure waves coming downwardly along the inner surface of said tube inwardly and upwardly to move liquid upwardly through said tube and through the lateral port when the latter is open.

11. The sonic pressure wave surface operated single tube pump of claim 10 in which the recess in the end face of said piston is defined by a flat annular ring-like surface, a truncated conical surface opening onto said ring-like surface and a cylindrical end socket communicating with the small end of said truncated conical surface.

12. The sonic pressure wave surface operated single tube pump of claim 10 wheren said metallic tube is of steel.

13. The sonic pressure wave surface operated single tube pump of claim 10 in which said housing is connected to the lower end of said metallic tube by a truncated conical transition wall.

14. The sonic pressure wave surface operated single tube pump of claim 10 in which said power operated means includes a fly wheel, a crank arm connected to said fly wheel and a piston rod connected to said crank arm and said piston.

15. The sonic pressure wave surface operated single tube pump of claim 10 together with a bleed valve at the lower end of said plunger.

16. The sonic pressure wave surface operated single tube pump of claim 10 in which there are a pair of aligned one-way check valves at the lower end of the cylinder and which communicates with the liquid in the underground level.

17. The sonic pressure wave surface operated single tube pump of claim 10 wherein said sonic nozzle comprises:

(a) a plug-shaped body having an axial bore;

(b) said body having an upwardly disposed inverted frustro-conical surface and a downwardly disposed frustro-conical surface which cooperatively form the axial bore through said body; and (c) said body having a diametrically opposed pair of helical grooves formed in the upwardly disposed inverted frustro-conical surface thereof.

18. The sonic pressure wave surface operated single tube pump of claim 10 wherein the substantially flat upper surface of said plunger is provided with an endless groove formed therein.

* * * * *